United States Patent [19]

Sorimachi et al.

[11] Patent Number: 4,661,667

[45] Date of Patent: Apr. 28, 1987

[54] TWO-STAGE LOCKING PUSH SWITCH

[75] Inventors: Mitsuo Sorimachi; Mamoru Sato, both of Isesaki, Japan

[73] Assignee: Hosiden Electronics Co., Ltd., Osaka, Japan

[21] Appl. No.: 799,083

[22] Filed: Nov. 18, 1985

[30] Foreign Application Priority Data

Nov. 21, 1984 [JP] Japan ..... 59-177226[U]
Mar. 6, 1985 [JP] Japan ..... 60-32577[U]

[51] Int. Cl.[4] ..... H01H 9/00; H01H 3/00

[52] U.S. Cl. ..... 200/314; 200/153 J; 200/313

[58] Field of Search ..... 200/153 J, 153 JH, 310–317, 200/16 R, 291

[56] References Cited

U.S. PATENT DOCUMENTS

| | | | |
|---|---|---|---|
| 4,254,315 | 3/1981 | Stevens | 200/153 J |
| 4,395,611 | 7/1983 | Kondo et al. | 200/311 |
| 4,454,399 | 6/1984 | Suzuki | 200/313 |
| 4,467,159 | 8/1984 | Ota et al. | 200/153 J |

FOREIGN PATENT DOCUMENTS

| | | | |
|---|---|---|---|
| 2089131 | 6/1982 | United Kingdom | 200/314 |

*Primary Examiner*—James E. Bryant, III
*Assistant Examiner*—Linda J. Sholl
*Attorney, Agent, or Firm*—Pollock, Vande Sande and Priddy

[57] ABSTRACT

A heart cam type locking mechanism is provided by which in response to a first push button depressing operation, a moving member is locked at a first position in a casing, the moving member is locked at a second position in response to a second push button depressing operation and the moving member is returned to its initial position in response to a third push button depressing operation. The inside of the push button is divided by a partition plate into first and second optical path spaces. A lamp is disposed in the casing so that it emits light into the first and second optical path spaces. A light shielding plate of a resilient material is disposed in the first optical path space and fixed at one end to the moving member. When the moving member is at the initial and first positions, the light shielding plate does not engage a tapered projection formed on the casing, but when the moving member is at the second position, the light shielding plate moves on the tapered projection, closing the first optical path space. First and second display portions are provided on the push button at positions corresponding to the first and second optical path spaces, respectively. When a hook spring of the heart cam type locking mechanism moves on a blocking projection for providing a physical response to the first depressing operation, a stopper projecting out of the casing prevents the hook spring from moving back to a returning passage, engaging it with a second heart cam.

16 Claims, 10 Drawing Figures

TWO-STAGE LOCKING PUSH SWITCH

BACKGROUND OF THE INVENTION

The present invention relates to a two-stage locking push switch which is provided with an actuator having two locking positions, and more particularly to a two-stage locking push switch of the type in which when the actuator is depressed by one step into the switch casing, it is locked at a first position where it places the switch in its first state, and when the actuator is further depressed by another step it is locked at a second position where it places the switch in its second state, and when the actuator is further depressed by another step it is returned to its initial position where it holds the switch in its initial state (usually in the OFF state).

This kind of two-stage locking push switch is employed, for example, as an actuating switch of an automotive air conditioner. When the actuator is depressed by one step from the inoperative state of the air conditioner and is locked at a first position, the air conditioner is placed in its normal operative state in which its cooling power is relatively large and the inside of the car is cooled properly. When the actuator is further depressed by another step and locked at a second position, the air conditioner is put in its economical running state in which its cooling power is lowered to reduce power consumption. Then, when further depressed by another step, the actuator springs back to its initial position where the air conditioner is out of operation.

For displaying the individual operative states of the switch, the prior art has utilized such an arrangement as follows: a forwardly extending optical path of the switch casing on the side of the actuator (usually in the form of a push button) is divided into two optical paths, in which two lamps are respectively disposed. When the actuator is at the abovesaid first position, the two lamps are both lighted to illuminate the entire area of the front of the actuator (the top end face of the push button). When the actuator is at the abovesaid second position, only one of the lamps is lighted to illuminate the half of the entire area of the front of the actuator.

As mentioned above, the conventional two-stage locking push switch employs two lamps and sometimes lights them at the same time, in which case they give off much heat, raising the temperature of the switch and resulting in the service life of the lamps being short. Furthermore, the switch must be constructed so that it withstands high temperatures and the lamps are relatively expensive, increasing the manufacturing cost of the switch.

Moreover, the conventional push switch of this kind is designed so that when the actuator is pushed by a stroke past the first locking position and down to the second locking position, an operator can feel it immediately by the touch on the actuator. But such a structure introduces the possibility that once depressed to an extremity of a stroke, the actuator may not be locked at either of the first and second positions but may be returned to its initial position. Furthermore, the situation occasionally arises where although the actuator is locked at the second position when depressed from its initial position, the touch is so soft that it is difficult to judge whether the actuator is locked at the first or second position.

Such a conventional two-stage locking push switch is disclosed, for example, in U.S. Pat. No. 4,467,159 (issued on Aug. 21, 1984). Prior art problems will be described with reference to FIGS. 1 and 2, which show a slight modification of this United States patent to resemble the present invention in arrangement of a hook spring.

A moving member 12 is slidably mounted in an elongated tubular casing 11 having a rectangular crosssection. An actuator (a push button) 13 is mounted on that portion of the moving member 12 projecting out from the tubular casing 11. A coiled spring 14 is interposed between the moving member 12 and the rear panel of the tubular casing 11, by which the moving member 12 is biased forwardly, that is, in such a direction that the actuator 13 projects out of the tubular casing 11. A hook spring 15 is provided to extend above the moving member 12 in the front-to-back direction of the casing 11. The rear end of the hook spring 15 is secured as by winding in a coil form to an auxiliary plate 16 fixed to the rear panel of the tubular casing 11. The free end of the hook spring 15 is bent substantially at right angles towards the moving member 12 to form an engaging portion 18 for resilient engagement with the moving member 12. As the moving member 12 moves in the axial direction, the engaging portion 18 slides on a sliding face 17 of the moving member 12. The sliding face 17 has protrusively provided thereon first and second heart cams 21 and 22. The heart cams 21 and 22 are disposed with their recessed portions 23 and 24 facing the actuator 13, and they are staggered relative to each other both in the axial direction and in the direction perpendicular thereto. The sliding face 17 has a raised portion 26 along the first and second heart cams 21 and 22 on one side thereof and the engaging portion 18 of the hook spring 15 is urged towards the raised portion 26, that is, to the left in FIGS. 1 and 2. The sliding face 17 has another raised portion 27 on the side of the actuator 13. A projection **27*a* is provided which projects from the raised portion 27 towards the recessed portion 24 of the second heart cam 22**.

Adjacent the sliding face 17 is provided a high land 63 on which movable contact pieces 31 and 32 are mounted. The high land 63 is higher than the first and second heart cams 21 and 22. A guide bank 28 is provided which extends from the vicinity of the recessed portion 23 of the first heart cam 21 and along the second heart cam 22 on the side of the contact pieces 31 and 32. A blocking projection 29 is provided which extends from the axially central portion of the guide bank 28 to the high land 63.

FIG. 2 illustrates on an enlarged scale the sliding face 17 which has formed thereon the heart cams 21, 22 shown in FIG. 1. A first displacement passing $l_1$ of the engaging portion 18 of the hook spring 15 is formed from a starting point $P_1$ (where the actuator 13 is at the most protruded position) to the recessed portion 23, as indicated by the broken line. That is, when the actuator 13 is depressed into the casing 11, the engaging portion 18 starts to slide on the sliding face 17 at the point $P_1$, displaces along the side face of the first heart cam 21 and then strikes against the blocking projection 29 to slide into the recessed portion 23. From the recessed portion 23 to the recessed portion 24 there is formed a second displacement passage $l_2$ along the side face of the second heart cam 22, as indicated by the one-dot chain line. From the recessed portion 24 of the second heart cam 22 to the starting point $P_1$ of the first displacement passage $l_1$ there is formed a third displacement passage $l_3$, as indicated by the two-dot chain line. Between the end of the passage $l_3$ and the beginning of the passage $l_1$ there is formed a step in alignment with the passage $l_1$,as indicated by the line 82, so that the sliding face 17 is lower on the side of the passage $l_1$ than on the side of the passage $l_3$.

When the actuator 13 is depressed by one step from its most protruded position into the switch casing 11, the engaging portion 18 of the hook spring 15 displaces on the sliding face 17 along the first passage $l_1$ and then strikes against the blocking projection 29. Feeling the strike, an operator releases his hand from the actuator 13, allowing the engaging portion 18 to displace, by its own biasing force, towards the guide bank 28. At the same time, the actuator 13 is urged by the coiled spring 14 (FIG. 1) to project out of the casing 11, so that the engaging portion 18 is moved into the recessed portion 23. That is, the hook spring 15 is caught on the heart cam 21 and the moving member 12 is locked at this first position relative to the tubular casing 11.

When the actuator 13 is further depressed by another step into the casing 11 from the first position, the engaging portion 18 displaces along the recessed portion 23 towards the second heart cam 22 and then displaces along the side face of the second heart cam 22, that is, the engaging portion 18 moves along the second passage $l_2$ and strikes against the raised portion 27. Again feeling the strike, the operator releases his hand from the actuator 13, allowing the engaging portion 18 to be forced into the recessed portion 24 by the biasing force of the hook spring 15 and the returning force of the actuator 13. Thus the hook spring is caught on the heart cam 22 and the moving member 12 is locked at this second position.

When the operator releases his hand from the actuator 13 after further depressing it from the second position, the moving member 12 is moved back by the coiled spring 14, by which the engaging portion 18 returns to its starting point $P_1$ via the third displacement passage $l_3$.

As described above, in the conventional two-stage push switch, the moving member is locked at the first position releasing the actuator in response to the striking of the engaging portion 18 against the blocking projecting 29 in the first actuator depressing operation. If, however, the actuator is depressed too forcibly, the hook spring 15 is likely to be deformed or broken. To avoid this, the prior art push switch is arranged so that when the actuator is depressed too forcibly, the engaging portion 18 gets over the blocking projection 29. In such a case, the engaging portion 18 follows the broken-line passage $l_4$ to move along the guide back 28 on the side opposite from the second heart cam 22 to reach the side face of the projection 27*a*. When releasing the actuator 13, the engaging portion 18 settles into the recessed portion 24.

In practice, however, there are cases where when dashing against the blocking projection 29, the engaging portion 18 jumps up onto the guide bank 28 owing to the lateral biasing force of the hook spring 15 and thence moves across the second heart cam 22 along the broken-line passage $l_5$ to reach the corner portion between the raised portions 26 and 27 and thence returns to the starting point via the passage $l_3$ upon release of the actuator 13. That is, the moving member 12 is not locked at either of the first and second positions relative to the casing 11.

When the height of the blocking projection 29 is reduced so as to avoid such a situation, it is difficult to discern when the engaging portion strikes against the blocking projection 29, whereas when its height is too large, it is likely to bend the hook spring 15. Accordingly, it is necessary to set the shape and height of the blocking projection 29 at optimum values in accordance with the force of the hook spring 15, the shape of the engaging portion 18, the shape of the first passage $l_1$, the height and shape of the guide bank 28, the biasing force of the coiled spring 14, etc. but this is difficult to achieve.

SUMMARY OF THE INVENTION

It is therefore an object of the present invention to provide a two-stage locking push switch which employs only one light emitting element for the display of its operating state.

Another object of the present invention is to provide a two-stage locking push switch which ensures to produce such a physical indication as bumping feeling in the first actuator depressing operation, and ensures locking at the second position even if the actuator is depressed too strongly and which is easy to manufacture.

According to the present invention, the push switch is designed so that the moving member is able to assume initial, first and second positions in a tubular casing having a rectangular cross section. The moving member is provided with arm plates extending from both side corners of the moving member in parallel to each other to project out from the casing, thereby forming part of the actuator, and the arm plates are interconnected with each other by a partition plate horizontally extending from mid-points to the front ends of the arm plates at a mid-height thereof to thereby form upper and lower hallways above and below the partition plate and a hall between the two arm plates behind the rear ends of the hallways. One light emitting element, for example, a lamp is mounted inside the hall to irradiate the upper and lower hallways. A light shielding plate is provided in the upper or lower hallway to extend substantially in parallel to the partition plate. The light shielding plate is fixed at one end but its free end is movable in a direction perpendicular to the partition plate. As the moving member moves, the state of engagement of the light shielding plate with the casing varies, that is, the free end of the light shielding plate displaces in the direction perpendicular to the partition plate to intercept light from the lamp, preventing light from being transmitted forwardly (towards the actuator) through the hallway in which the light shielding plate is disposed. When the moving member returns to its initial position, the light shielding plate also gets out of the light shielding position to return to its initial position. According to the present invention, since the light shielding plate displaces in response to the operation of the actuator to permit or inhibit the passage of light through one of the optical paths as described above, two display states can selectively be produced by one illumination lamp.

Furthermore, according to the present invention, the actuator is locked in two stages through use of two heart cams as in the prior art, but a stopper is provided which prevents the hook spring from reaching the return passage leading to its initial position even if the first actuator depressing operation is so hard that the hook spring strikes against a blocking projection and jumps up to ride thereon. The stopper is provided between a line joining the center of rotation of the hook spring and the recess of the second heart cam and the abovesaid blocking projection and protrudes from the inner surface of the case facing the heart cam forming portion. The height of the stopper is selected so that it does not normally engage the hook spring but engages it when the spring jumps up onto the blocking projection so that the engaging portion of the hook spring lies on top of the heart cam forming portion. With the provision of this stopper, even if the first actuator depressing operation is so hard that the hook spring jumps up onto the blocking projection, the spring is blocked by the stopper from further movement to the return passage, ensuring that the hook spring settles into the recess of the second heart cam and is locked at the second position.

DESCRIPTION OF THE PREFERRED EMBODIMENTS

Figure 3:
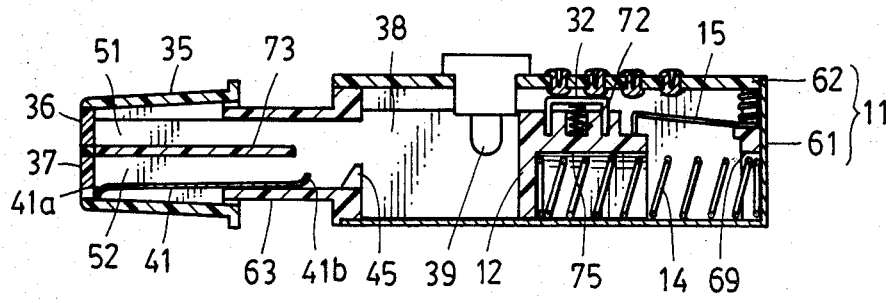
FIG. 3 is a cross-section view illustrating an example of the two-stage locking push switch of the present invention.
Figure 4:
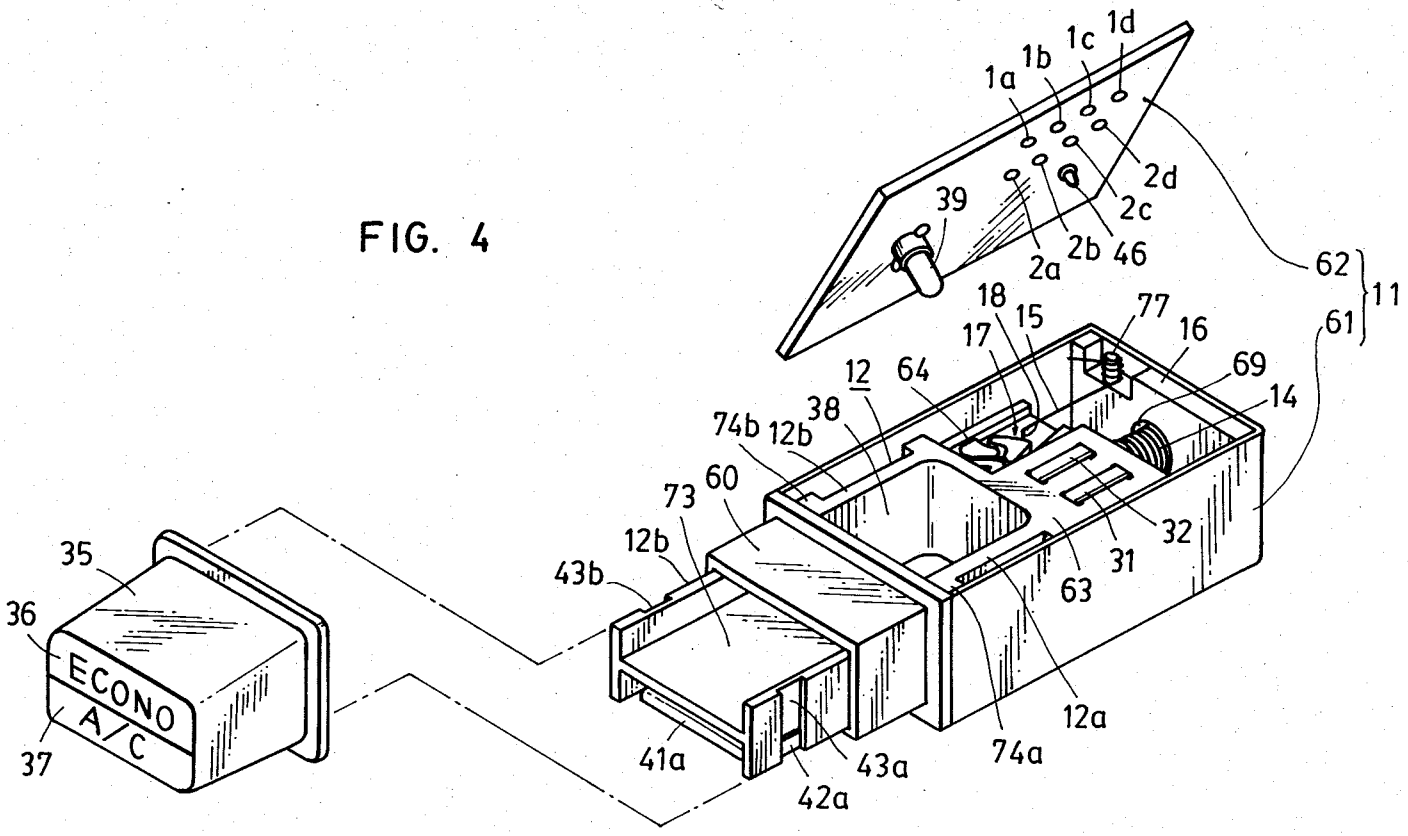
FIG. 4 is an exploded perspective view of the push switch shown in FIG. 3.

FIG. 3 illustrates in cross section an embodiment of the two-stage locking push switch of the present invention, and FIG. 4 is its exploded perspective view. The tubular casing 11 having a rectangular cross section comprises a box-shaped casing body 61 having its one side and one end opened and produced by bending sheet metal, and a printed circuit board 62 which covers the open side of the casing body 61. A rectangularly-sectioned, tubular guide frame 60 is fitted into the open end face of the casing body 61 to partly project therefrom. The moving member 12 is disposed in a manner to be movable in its axial direction.

Figure 5:
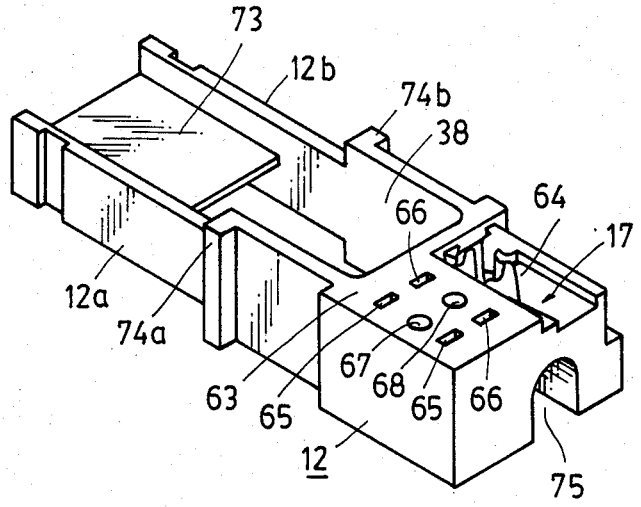
FIG. 5 is a perspective view of a moving member in FIG. 3.

The moving member 12 (see FIG. 5 also) is formed as a molding of synthetic resin and includes a high land contact holding portion 63 and a heart cam forming portion 64 which are disposed side by side in the lateral direction relative to the axis. The contact holding portion 63 has made therein pairs of slots 65 and 66 for receiving bent end portions of the movable contact pieces 31 and 32 and spring receiving holes 67 and 68 between the pairs of slots 65 and 66. The contact pieces 31 and 32 are loosely held in the slots 65 and 66 and coiled springs 71 and 72 (71 being not shown) are housed in the holes 67 and 68, respectively urging the contact pieces 31 and 32 towards the printed circuit board 62. The printed circuit board 62 has fixedly secured thereto contacts 1*a*, 1*b*, 1*c*, 1*d*, 2*a*, 2*b*, 2*c* and 2*d* in an area corresponding to the range of movement of the contact pieces 31 and 32, the contacts being arranged in the direction of movement of the contact pieces 31 and 32.

The moving member 12 has a pair of opposed arm plates 12*a* and 12*b* formed integrally therewith and projecting forwardly. The free end portions of the arm plates 12*a* and 12*b* project out forwardly of the guide frame 60. Between the end portions of the arm plates 12*a* and 12*b* is formed integrally therewith a partition plate 73 to extend horizontally from midpoints to front ends of the arm plates at an intermediate height thereof. On the outside of the arm plates 12*a* and 12*b* at their intermediate portions are formed integrally therewith flanges 74*a* and 74*b*, which abut against the inner end face of the guide frame 60.

Figure 2:
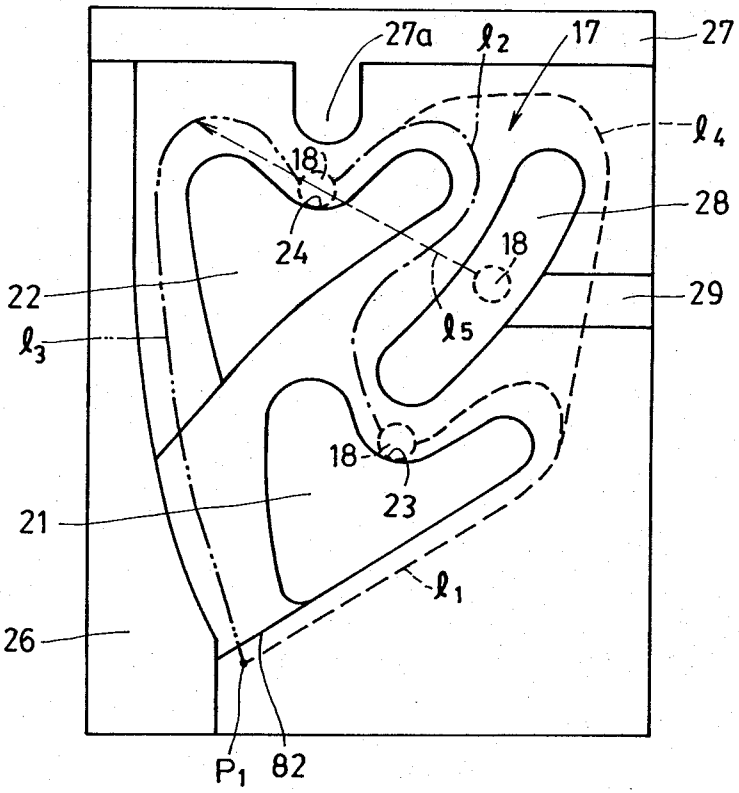
FIG. 2 PRIOR ART
FIG. 2 is an enlarged plan view of a cam forming portion 26 in FIG. 1.
Figure 1:
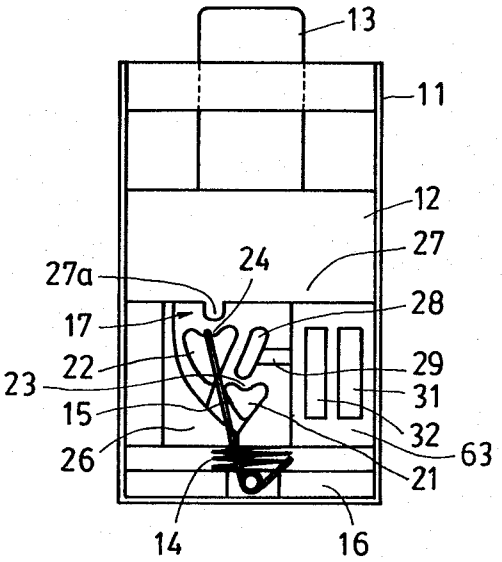
FIG. 1 PRIOR ART
FIG. 1 is a plan view showing a conventional two-stage locking push switch, with its printed circuit board taken off.
Figure 6:
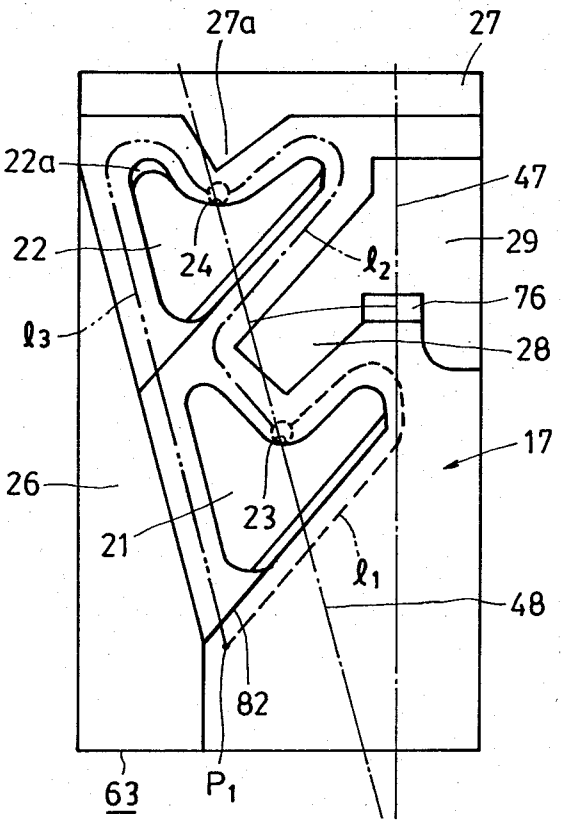
FIG. 6 is an enlarged plan view of the cam forming portion in FIG. 3.

In the casing 11 the moving member 12 is urged by the coiled spring 14 in the direction in which it projects out of the casing 11. The auxiliary plate 16 is fixed to the inside of the rear wall of the casing body 61, and both ends of the coiled spring 14 are disposed in a hole 69 made in the auxiliary plate 16 and a hole 75 made in the rear wall of the moving member 12. The heart cam forming portion 64 is lower in level than the contact holding portion 63, and cams 21, 22 shown in FIG. 6 are formed on the heart cam forming portion 64. These cams are substantially identical with the conventional cams 21, 22 shown in FIG. 2. The first heart cam 21, the second heart cam 22, the raised portions 26 and 27, the projections 27*a* and 28 and the blocking projection 29 are formed on the sliding face 17. In this embodiment the side face of the blocking projection 29 for blocking the engaging portion 18 of the hook spring 15 is tapered, as indicated by 76. The angle $\alpha$ of the tapered face 76 to the sliding face 17 is, for example, 70° or so. As depicted in FIG. 4, the hook spring 15 is disposed on the heart cam forming portion 64 as is conventional. One end portion of the hook spring 15 is wound around a pin 77 on the auxiliary plate 16 and the engaging portion 18 is urged against the sliding face 17 and at the same time biased to turn towards the raised portion 26.

Figure 7:
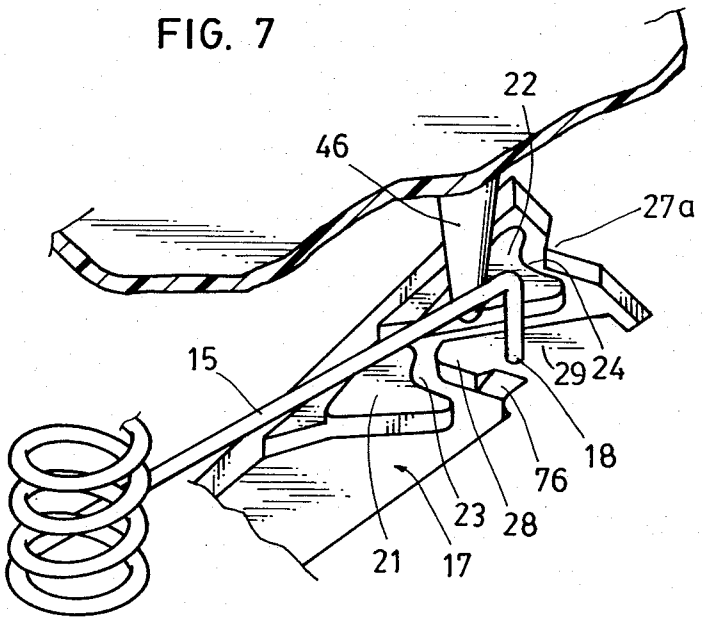
FIG. 7 is a perspective view showing the relationships between the cams, a hook spring 15 and a stopper 51 in FIG. 3.

According to the present invention, in order to prevent the engaging portion 18 from readily reaching the passage $l_3$ when it strikes against the blocking projection 29 hard and jumps up, a stopper 46 is protrusively provided on the printed circuit board 62, as shown in FIG. 7. The position of the stopper 46 on the printed circuit board 62 is selected such that when the moving member 12 is at a position where the engaging portion 18 strikes the tapered portion 76 of the blocking projection 29, the stopper 46 is inside an arc area covered by rotating the hook spring 15 from a line 47 connecting the tapered portion 76 and the rotation center (i.e. the pin 77) to a line 48 connecting the recess 24 of the second heart cam 22 and the rotation center as shown in FIG. 6. The height of the stopper 46 is selected so that it engages the hook spring 15 when the engaging portion 18 jumps up onto the guide bank 28 or the blocking projection 29 but the stopper 46 does not engage the hook spring in the normal operating state in which the engaging portion 18 remains in engagement with the sliding face 17. Even when the hook spring 15 has engaged the stopper 46, the engagement will be released by the vertical biasing force of the hook spring 15 against the sliding face 17 when the engaging portion 18 of the hook spring 15 comes immediately above the normal sliding face 17 as the moving member 12 moves. However, in order to make this disengagement easy, an engaging part of the stopper 46 is tapered. For example, the stopper 46 may be cone-shaped.

As depicted in FIGS. 3 and 4, a push button 35 serving as a part of the actuator is mounted on the projecting end portion of the arm plates 12*a*, 12*b* of the moving member 12. The push button 35 is fabricated as a rectangularly-sectioned, tubular molding having its front end face closed. The arm plates 12*a* and 12*b* of the moving member 12 are fixed to a pair of opposed interior surfaces of the push button 35 so that the inside space of the latter is divided by the partition plate 73 into upper and lower hallways 51 and 52. The guide frame 60 is loosely engaged into the push button 35. The front panel of the push button 35 is used as a transparent or semi-transparent display portion. The front end of the partition plate 73 abuts against the inner face of the front panel of the push button 35, so that the display portion is divided by the partition plate 73 into upper and lower display portions 36 and 37. In this example, the lower display portion 37 bears an indication "A/C" and the upper display portion 36 an indication "ECONO". Behind the rear end of the partition plate 73 is defined, between the arm plates 12*a* and 12*b*, a hall 38, in which is positioned a lamp 39 mounted on the printed circuit board 62. Light from the lamp 39 passes through the upper and lower hallways 51 and 52 in the guide frame 60 and the push button 35 each divided by the partition plate 73 into two, illuminating the display portions 36 and 37. The casing 11, the guide frame 63, the partition plate 73 and the other portions of the push button 35 except the display portions 36 and 37 are made nontransparent to light so that only the display portions 36 and 37 are illuminated by light from the lamp 39.

Figure 8:
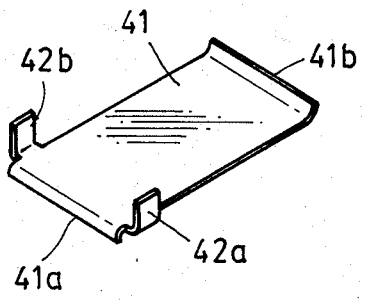
FIG. 8 is a perspective view showing a light shielding plate 41 in FIG. 3.
Figure 9:
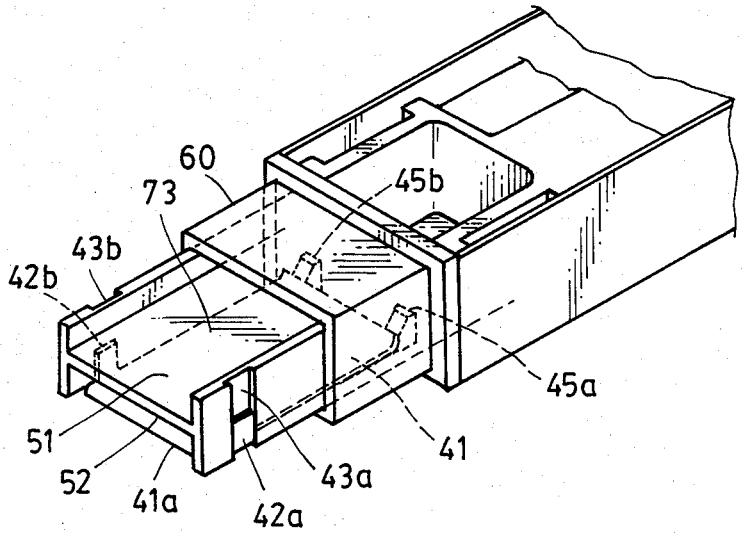
FIG. 9 is a perspective view showing the relationship between the light shielding plate 41 and a tapered projection 45 in FIG. 3.

A light shielding plate 41 is disposed in the hallway 52. The light shielding plate 41 is fixed at one end on the side of the push button, in the drawings, to the front end portions of the arm plates 12*a* and 12*b*. The other end of the light shielding plate 41 is free to be displaced in the direction perpendicular to the partition plate 73 in response to the predetermined movement of the moving member 12, optically closing the hallway 52 to inhibit the passage therethrough of light from the lamp 39 to the display portion 37. As shown in FIG. 8, the light shielding plate 41 is formed by a rectangular resilient sheet of metal such as stainless steel and it has a pair of engaging pieces 42*a* and 42*b* bent at right angles on both sides of its front end portion. The marginal front edge 41*a* on the side of the engaging pieces 42*a* and 42*b* is bent in the direction reverse from the latter and the marginal rear edge 41*b* of the other end is bent in the same direction as the engaging pieces 42*a* and 42*b*. The width of the light shielding plate 41 is slightly smaller than the width of the light transmitting hallway 52. As shown in FIG. 9 which illustrates the inside of the hallway 52 in the vicinity of the light shielding plate 41 and as shown in FIG. 3, the light shielding plate 41 is disposed between the arm plates 12*a* and 12*b* in spaced relation to the partition plate 73, the engaging pieces 42*a* and 42*b* are inserted in engaging grooves 43*a* and 43*b* made in the outer side faces of the arm plates 12*a* and 12*b* near front end portions thereof, the one marginal front edge 41*a* of the light shielding plate 41 abuts against the interior surface of the push button 35, and the other marginal rear edge 41*b* lies on the inner surface of the guide frame 60. On the inside of the guide frame 60 tapered projections 45*a* and 45*b* are provided integrally therewith on both sides of the path of the light shielding plate 41, so that in this example, when the moving member 12 is at the innermost position, i.e. at the second locking position, the rear end portion of the light shielding plate 41 runs on the tapered projections 45*a* and 45*b* to make resilient contact with the partition plate 73.

With the above arrangement, when the push button 35 is at the outermost position, the contact pieces 31 and 32 respectively short the contacts 1*a* and 1*b* and the contacts 2*a* and 2*b*, so that the lamp 39 is not lighted, and the engaging portion 18 of the hook spring 15 lies at the starting point $P_1$ of the passage $l_1$ in FIG. 6.

Depressing the push button 35, the engaging portion 18 moves along the passage $l_1$ and strikes against the blocking projection 29. Releasing the push button 35 in response to the colliding feeling, the engaging portion 18 moves into the recess 23 to be caught on the first heart cam 21, locking the moving member 12 at the first locking position. At this point the contact pieces 31 and 32 short the contacts 1*b* and 1*c* and the contacts 2*b* and 2*c*, respectively, lighting the lamp 39. The light from the lamp 39 is divided by the partition plates 73 into two beams, which pass through the hallways 51 and 52 to reach the display portions 36 and 37, from which they go out of the push button 35. Thus the display portions 36 and 37 are both illuminated.

Figure 10:
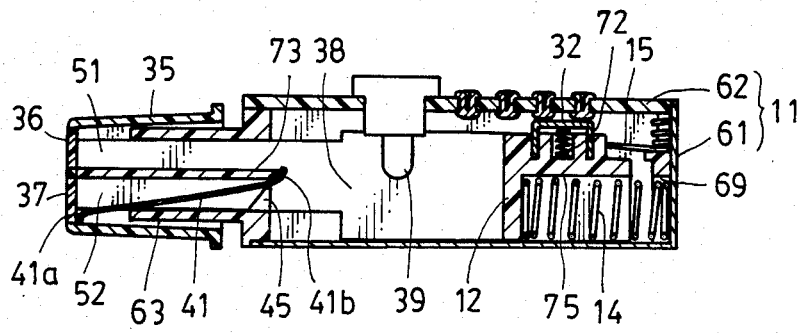
FIG. 10 is a cross-sectional view showing the state in which the moving member of the push switch of FIG. 3 is locked at the second position.

When the push button 35 is pressed from the above position until a distinct touch is produced, the engaging portion 18 displaces along the passage $l_2$ and strikes against the raised portion 27. Releasing the push button 35 in response to this, the engaging portion 18 is caught on the second heart cam 22 at the recess 24 thereof, locking the moving member 12 at this position. In this state the contact pieces 31 and 32 short the contacts 1*c* and 1*d* and the contacts 2*c* and 2*d*, respectively, retaining the lamp 39 in the ON state. In this depressing operation, as the moving member 12 moves, the marginal rear edge 41*b* of the light shielding plate 41 gradually moves on the tapered projections 45*a*, 45*b*, by which the light shielding plate 41 is elastically deformed and its end portion is resiliently urged against the inner edge of the partition plate 73, as depicted in FIG. 10. In consequence, the hallway 52 is closed to intercept the light of the lamp 39. In other words, the display portion 37 is not illuminated and only the display portion 36 is illuminated, providing the display "ECONO" alone in this example.

When the operator releases his hand from the push button 35 after depressing it from the above state, the moving member 12 is pushed out by the coiled spring 14 and the engaging portion 18 returns to the starting point $P_1$ passing along the return passage $l_3$. The light shielding plate 41 disengages from the tapered projections 45*a*, 45*b* and its elastic deformation is restored, so that it contacts the inner surface of the guide frame 60 again, thus returning to its initial state. By releasing the push button 35 after slightly pressing it in the state in which the engaging portion 18 is in engagement with the heart cam 21 at the recess 23, the engaging portion 18 moves through the passage between the heart cams 21 and 22 to the return passage $l_3$ and returns directly to the starting point $P_1$.

Since the angle of the tapered face 76 of the blocking projection 29 is selected to be about 70° as referred to previously, the collision of the engaging portion 18 with the blocking projection 29 when the push button 35 is pressed in the state in which the engaging portion 18 is at the starting point $P_1$. But when the pressing force is too large, the engaging portion 18 moves on to the blocking projection 29 along the tapered face 76 without being bent. In this case, the engaging portion 18 thus lying on the blocking projection 29 is prevented by the stopper 46 from moving to the passage $l_3$, as shown in FIG. 7, and it collides with the raised portion 27, settling into the recess 24. Accordingly, it is also possible to displace the engaging portion 18 in a single stroke, i.e., by one push button depressing operation, from the starting point $P_1$ to the recess 24. Therefore, the engaging portion 18 can be displaced from the starting point $P_1$ to either selected one of the recesses 23 and 24. In our experiment in which a spring wire of a 0.6 mm diameter was used as the hook spring 15, the coil at its one end had 4 turns with an inner diameter of 2.8 mm, the length of the hook spring 15 from the center of the coil to the engaging portion 18 was 14 mm, the engaging portion 18 was 2.7 mm long, the angle between the extending portion of the hook spring and the end portion of its coil was reduced from about 90° to 40°, the angle of the tapered face 76 was 70° and its height was 11.5 mm, a distinct touch for positioning the engaging portion in the recess 24 from the starting point $P_1$ could be obtained, the engaging portion 18 could be brought to the recess 24 at a stroke without being bent and the push switch was stable in operation for a long time.

As described previously, simultaneous illumination of the display portions 36 and 37 and the illumination of only the display portion 36 can be achieved through use of one lamp 39, so that the amount of heat generated is smaller than in the case of employing two lamps. Accordingly, the temperature of the switch remains low and the lifetime of the lamp is long.

In the case where the engaging portion 18 is returned from the recess 23 to the starting point $P_1$ via the recess 24 at all times, it is necessary only to couple the heart cams 21 and 22 into a single cam of such a shape as indicated by the broken line in FIG. 6 so that the passage to $l_3$ from between the cams 21 and 22 is removed. While in the above the partition plate 73 is provided in parallel to the printed circuit board 62, it may also be disposed at right angles to the plane containing the printed circuit board 62.

It will be apparent that many modifications and variations may be effected without departing from the scope of the novel concepts of the present invention.

What is claimed is:

1. A two-stage locking push switch comprising a rectangularly-sectioned, tubular casing having one end face opened and having a printed circuit board on one side thereof;

a moving member received in the casing but partly projecting out of its open end face and slidable in parallel with its axis;

a spring for urging the moving member in a direction in which it projects out of the casing;

a pushbutton mounted on the projecting portion of the moving member;

a cam type locking mechanism provided between the moving member and the casing, for locking the moving member at a first position in response to a first pushbutton depressing operation, for locking the moving member at a second position in response to a second pushbutton depressing operation, and for returning the moving member to its initial position in response to a third pushbutton depressing operation;

a contact piece held on the moving member in opposing relation to the printed circuit board;

a plurality of contacts held on the printed circuit board in an area corresponding to the range of movement of the contact piece, for selectively contacting the contact piece in accordance with the first, second and initial positions of the moving member;

a partition plate for dividing the inside of the pushbutton into first and second optical path spaces;

a light emitting element in said casing for emitting light into the first and second optical path spaces at the same time;

first and second display portions respectively provided in the first and second optical path spaces of the pushbutton, for providing displays when irradiated by light from the light emitting element;

a light shielding plate mounted at one end to the moving member in the first optical path space and extending therein in opposing relation to the partition plate;

projecting means mounted on the casing, for engaging the light shielding plate in accordance with the position of movement of the moving member to displace the light shielding plate towards the partition plate, thereby closing the first optical path space to intercept light from the light emitting element;

the projecting portion of said moving member having a pair of opposed arm plates extending from a main body of the moving member in the casing and projecting out therefrom, said arm plates being inserted into said pushbutton, the said arm plates being coupled together by said partition plate on the side of said pushbutton, and said light emitting element being disposed between said pair of arm plates behind a rear end of the partition plate; and a guide frame secured to the open end face of the casing in a manner to project out therefrom, said arm plates projecting out of the casing further than the guide frame, and the pushbutton being in loose engagement with said guide frame, said light shielding plate being placed on an inner surface of said guide frame, said projecting means being formed on the inside of said guide frame integrally therewith, the arrangement being such that when the moving member is at the initial position and at said first position the light shielding plate is not on said projecting means, but when the moving member is at said second position the light shielding plate is positioned on said projecting means, the face of said projecting means on the side of the light shielding plate being tapered to gently rise, and the marginal portion of the light shielding plate on the side of said projecting means being bent to depart from the inner surface of said guide frame.

2. A two stage locking push switch comprising:

a rectangularly-sectioned, tubular casing having one end face opened and having a printed circuit board on one side;

a moving member received in the casing but partly projecting out of its open end face and slidable in parallel with its axis;

a coiled spring for urging the moving member in a direction in which it project out of the casing;

a push button mounted on the projecting end of the moving member;

a cam type locking mechanism including a cam forming portion provided with first and second heart cams formed on the moving member and staggered from each other with respect to the axial direction and a direction perpendicular thereto and a blocking projection formed on the moving member between the first and second heart cams and staggered therefrom with respect to the axial direction and in the direction perpendicular thereto, and a hook spring engaged at one end with the cam forming portion and fixed at the other end to the casing and biased to turn in one direction, whereby in response to a first path button depressing operation the hook spring is brought into engagement with a recess of the first heart cam to lock the moving member at a first position, in response to a second push button depressing operation the hook spring is brought into engagement with a recess of the second heart cam to lock the moving member at a second position and in response to a third push button depressing operation the hook spring is disengaged from the second heart cam to return the moving member to its initial position;

a contact piece held on the moving member in opposing relation to the printed circuit board;

a plurality of contacts held on the printed circuit board in an area corresponding to the range of movement of the contact piece, for selectively contacting the contact piece in accordance with the first, second and initial positions of the moving member; and a stopper projecting out from the inside of the casing towards the cam type locking mechanism, for preventing the hook spring, when it strikes and has moved on to the blocking projection, from reaching a returning passage on the cam forming portion of the cam type locking mechanism.

3. A two-stage locking push switch according to claim 2 wherein the stopper is positioned on the opposite side from the direction of rotation of the hook spring with respect to a line joining the center of rotation of the hook spring and the recess of the second heart cam.

4. A two-stage locking push switch according to claim 3 wherein the cam forming portion is provided in opposing relation to the printed circuit board; and the stopper is mounted on the printed circuit board.

5. A two-stage locking push switch according to claim 4 wherein the side face of the blocking projection against which the hook spring strikes is inclined about 70° to the plane in which the first and second heart cams are provided.

6. A two-stage locking push switch according to claim 3 wherein the first and second heart cams are coupled together, closing a passage from therebetween to the returning passage.

7. A two-stage locking push switch according to claim 3 including a partition plate for dividing the inside of the push button into first and second optical path spaces; a light emitting element mounted on the printed circuit board, for emitting light into the first and second optical path spaces at the same time; first and second display portions respectively provided in the first and second optical path spaces of the push button, for providing displays when irradiated by light from the light emitting element; a light shielding plate of a resilient material fixed at one end to the moving member in the first optical path space and extending therein in opposing relation to the partition plate; and a projecting means mounted on the casing, for engaging the light shielding plate in accordance with the position of movement of the moving member to elastically deform the light shielding plate towards the partition plate, thereby closing the first optical path space to intercept light from the light emitting element.

8. A two-stage locking push switch according to claim 7 wherein the projecting portion of the moving member has a pair of opposed arm plates extending from a main body of the moving member and projecting out of the casing; the partition plate is integrally coupled with the projecting arm plates therebetween; the free end portions of the arm plates, are inserted into the push button; a guide frame is received in the open end face of the casing projecting out therefrom; the guide frame is loosely engaged with the push button; and the projecting means is formed integrally with the guide frame.

9. A two-stage locking push switch according to claim 8 wherein when the moving member is at the initial and first position, the light shielding plate is out of contact with the projecting means and when the moving member is at the second position, the light shielding plate moves on the projecting means and is elastically deformed to be in contact with the partition plate.

10. A two-stage locking push switch comprising a rectangularly-sectioned, tubular casing having one end face opened and having a printed circuit board on one side thereof;

a moving member received in the casing but partly projecting out of its open end face and slidable in parallel with its axis;

a spring for urging the moving member in a direction in which it projects out of the casing;

a pushbutton mounted on the projecting portion of the moving member;

a cam type locking mechanism provided between the moving member and the casing, for locking the moving member at a first position in response to a first pushbutton depressing operation, for locking the moving member at a second position in response to a second pushbutton depressing operation, and for returning the moving member to its initial position in response to a third pushbutton depressing operation;

a contact piece held on the moving member in opposing relation to the printed circuit board;

a plurality of contacts held on the printed circuit board in an area corresponding to the range of movement of the contact piece, for selectively contacting the contact piece in accordance with the first, second and initial positions of the moving member;

a partition plate for dividing the inside of the pushbutton into first and second optical path spaces;

a light emitting element in said casing for emitting light into the first and second optical path spaces at the same time;

first and second display portions respectively provided in the first and second optical path spaces of the pushbutton, for providing displays when irradiated by light from the light emitting element;

a light shielding plate mounted at one end to the moving member in the first optical path space and extending therein in opposing relation to the partition plate; and projecting means mounted on the casing, for engaging the light shielding plate in accordance with the position of movement of the moving member to displace the light shielding plate towards the partition plate, thereby closing the first optical path space to intercept light from the light emitting element;

said light shielding plate being fabricated of a flexible material, said one end of said light shielding plate being fixed in position on said moving member in spaced relation to said partition plate, said displacement of said light shielding plate by said projecting means constituting an elastic deformation of said light shielding plate about its said one end for moving the other end of said light shielding plate into engagement with said partition plate.

11. A two-stage locking push switch according to claim 10 wherein said light emitting element is mounted on said printed circuit board.

12. A two-stage locking push switch comprising a rectangularly-sectioned, tubular casing having one end face opened and having a printed circuit board on one side thereof;

a moving member received in the casing but partly projecting out of its open end face and slidable in parallel with its axis;

a spring for urging the moving member in a direction in which it projects out of the casing;

a pushbutton mounted on the projecting portion of the moving member;

a cam type locking mechanism provided between the moving member and the casing, for locking the moving member at a first position in response to a first pushbutton depressing operation, for locking the moving member at a second position in response to a second pushbutton depressing operation, and for returning the moving member to its initial position in response to a third pushbutton depressing operation;

a contact piece held on the moving member in opposing relation to the printed circuit board;

a plurality of contacts held on the printed circuit board in an area corresponding to the range of movement of the contact piece, for selectively contacting the contact piece in accordance with the first, second and initial positions of the moving member;

a partition plate for dividing the inside of the pushbutton into first and second optical path spaces;

a light emitting element in said casing for emitting light into the first and second optical path spaces at the same time;

first and second display portions respectively provided in the first and second optical path spaces of the pushbutton, for providing displays when irradiated by light from the light emitting element;

a light shielding plate mounted at one end to the moving member in the first optical path space and extending therein in opposing relation to the partition plate; and projecting means mounted on the casing, for engaging the light shielding plate in accordance with the position of movement of the moving member to displace the light shielding plate towards the partition plate, thereby closing the first optical path space to intercept light from the light emitting element;

said cam type locking mechanism including a cam forming portion provided with first and second heart cams formed on the moving member, a blocking projection formed on the moving member between the first and second heart cams and staggered therefrom, and a hook spring engaged at one end with the cam forming portion and fixed at its other end to the casing, said hook spring being biased to turn in one direction about its said other end, the arrangement being such that in response to said first pushbutton depressing operation said one end of the hook spring moves into engagement with a recess of the first heart cam to lock the moving member at said first position, in response to said second pushbutton depressing operation said one end of the hook spring moves into engagement with a recess of the second heart cam to lock the moving member at said second position, and in response to said third pushbutton depressing operation said one end of the hook spring is disengaged from the second heart cam and moves into a return passage on the cam forming portion to return the moving member to its said initial position; and a stopper projecting from the inside of the casing towards the cam type locking mechanism for preventing said one end of the hook spring, if it should strike and move onto said blocking projection, from reaching said return passage on the cam forming portion of the cam type locking mechanism.

13. A two-stage locking push switch according to claim 12 wherein the stopper is positioned between said blocking projection and a line extending from said other end of the hook spring to the recess of the second heart cam.

14. A two-stage locking push switch according to claim 13 wherein said cam forming portion is provided in opposing relation to said printed circuit board, said stopper being mounted on the printed circuit board.

15. A two-stage locking push switch according to claim 14 wherein said blocking projection has a side face, against which the hook spring strikes, which is inclined about 70° to the plane of said first and second heart cams.

16. A two-stage locking push switch according to claim 13 wherein the first and second heart cams are so coupled together that there is no passage which extends between said cams to said return passage.

* * * * *